United States Patent [19]

Flory

[11] 3,979,785

[45] Sept. 14, 1976

[54] COMBINED CATENARY AND SINGLE ANCHOR LEG MOORING SYSTEM

[75] Inventor: John F. Flory, Morris Township, N.J.

[73] Assignee: Exxon Research and Engineering Company, Linden, N.J.

[22] Filed: Aug. 9, 1974

[21] Appl. No.: 496,306

[52] U.S. Cl. ..... 9/8 P; 141/387; 114/230

[51] Int. Cl.[2] ..... B63B 21/52

[58] Field of Search ..... 9/8 R, 8 P, 8.5; 114/.5 T, 206 R, 230; 61/46, 46.5; 141/387–388; 285/190

[56] References Cited

UNITED STATES PATENTS

| | | | |
|---|---|---|---|
| 3,515,182 | 6/1970 | Dickson et al. | 141/387 |
| 3,606,397 | 9/1971 | Flory | 285/190 |
| 3,641,602 | 2/1972 | Flory et al. | 9/8 P |
| 3,674,062 | 7/1972 | Ellers et al. | 141/387 |
| 3,838,718 | 10/1974 | Flory et al. | 9/8 P |

*Primary Examiner*—Trygve M. Blix
*Assistant Examiner*—Jesus D. Sotelo
*Attorney, Agent, or Firm*—F. Donald Paris; R. D. Hantman

[57] ABSTRACT

A combined catenary and single anchor leg mooring system capable of transferring cargo from vessels moored thereto includes an anchor hub suspended by a single anchor leg from a mooring buoy floating on the surface of the sea. A plurality of catenary anchor legs connect to the anchor hub and extend outward and downward to anchors secured in the sea bottom. A cargo transfer swivel assembly is mounted on the anchor hub, and is rotatable about the lower connection point of the single anchor leg. Cargo hose extends from a pipeline manifold located on the sea floor to piping in the anchor hub, and additional cargo hose extends from the swivel assembly to the sea surface and then to the moored tanker.

7 Claims, 2 Drawing Figures

COMBINED CATENARY AND SINGLE ANCHOR LEG MOORING SYSTEM

FIELD OF THE INVENTION

This invention relates to single point mooring systems for tankers and more particularly to a combined catenary and single anchor leg mooring system with integral cargo handling facilities. According to a preferred embodiment, a plurality of catenary anchor legs conventionally connected to the sea bottom by means of anchors, join at a hub located beneath the sea surface, and a single anchor leg connected to a center shaft projecting above this hub extends upward to a buoy floating at the sea surface and to which the tanker is moored. A cargo swivel housing rotatably mounted about the shaft is in fluid communication with piping through the hub. Hose from a submarine pipeline manifold on the sea floor connects to the piping in the hub and hose connected to the cargo swivel housing rises to the sea surface where it may be lifted to the tanker manifold.

BACKGROUND OF THE INVENTION

The single point mooring system for tankers, in which the tanker is moored to a single point while remaining free to rotate about the mooring point to align with the environmental forces and in which a cargo transfer means is integrated with the mooring system to permit continuous cargo transfer while the tanker rotates, has evolved during the past 15 years and is now the preferred mooring for very large tankers and deep water production fields. The primary requirements for such single point moorings are that they be a safe mooring and cargo transfer system at which mishaps resulting in damage and pollution are unapt to occur, and that they also be an efficient and economical system for which the costs of installation and operation are not excessive.

Most single point moorings now in use are of the catenary anchor leg mooring design comprised of a floating mooring buoy anchored by a number of catenary anchor chains connected to the periphery of the buoy which extend radially outward and downward to anchor points some distance from the buoy, as typically disclosed in U.S. Pat. No. 3,074,032. In deep water installations large and very long anchor chains are required and the cost of these chains is substantial, sometimes making such a mooring system excessively expensive. These systems further include floating cargo hose which connects to a cargo swivel mounted on the deck of the floating mooring buoy. The floating cargo hose experiences excessive wear at the point of connection between the hose and the buoy, and is exposed to damage should the tanker move forward and strike the buoy.

Some recent single point mooring installations which comprise more advanced single anchor leg mooring design are disclosed in U.S. Pat. No. 3,606,397 and 3,641,602, in which the mooring buoy is anchored by a single anchor leg and the hose connects to a submerged cargo swivel concentric with the anchor leg and mounted either on a mooring base or on a shaft pivoted on the mooring base. In this design the problem of excessive hose wear at the buoy connection and the danger of cargo system damage resulting from a tanker impacting the buoy are eliminated.

Further, in deep water installations the single anchor leg mooring has been proven to be less expensive than the catenary anchor leg mooring because the several very long anchor chains are replaced by a short anchor chain and a mooring base. The mooring base of the single anchor leg mooring may comprise a large hollow structure which is lowered to the ocean floor, filled with sand or other material to increase its mass to resist uplift, and pinned to the floor by piles or other means to resist sliding. In very deep water, installation of the base may prove difficult, and it may be advantageous to employ relatively short catenary chains to anchor the shaft through the center of the submerged cargo swivel. This is the basis of the present invention, which retains the advantages of the single anchor leg mooring.

In addition to the aforementioned prior art, reference also is made to U.S. Pat. Nos. 3,386,407 and 3,515,182. U.S. Pat. No. 3,386,407 discloses a mooring system for ships in which three or more catenary anchor legs extend directly from anchors on the sea floor to the side of the ship and are coupled at a point near the ocean floor by a ring which is slid down the anchor legs. An advantage of the present invention over the prior art is that it provides a cargo transfer system integral with the mooring system, thus allowing cargo transfer to continue while the tanker rotates around the mooring. U.S. Pat. No. 3,515,182 describes a mooring and loading system in which the mooring swivel surrounds the cargo conduit and in which the mooring lines extend directly to this mooring swivel to the tanker without the benefit of a mooring buoy. An advantage of the present invention over the prior art is that the mooring buoy supports the anchor hub above the sea bottom which provides for a more favorable mooring system elasticity, thus reducing the mooring loads. Furthermore, the present invention provides a relatively small compact mooring swivel which can better be designed to resist the mooring loads and to seal out water.

SUMMARY OF THE INVENTION

Accordingly, it is a primary objective of the present invention to provide a mooring and cargo transfer system having a surface buoy, a single anchor leg including mooring swivel extending downward from the mooring buoy and connected to a load carrying shaft on an anchor hub, a plurality of catenary anchor legs extending outward from the anchor hub to anchors secured to the sea bottom, and a cargo transfer swivel assembly rotatably mounted about the shaft on the anchor hub and operably connected to hose extending to the moored tanker and to hose extending to a submarine pipeline manifold.

Having in mind the above and other objectives that will be evident from an understanding of this disclosure, the invention comprises the combinations and arrangements as illustrated in the presently preferred embodiment of the invention which is hereinafter set forth in such detail as to enable those skilled in the art readily to understand the function, operation, construction and advantages of it when read in conjunction with the accompanying drawings.

DESCRIPTION OF THE PREFERRED EMBODIMENT

Figure 1:
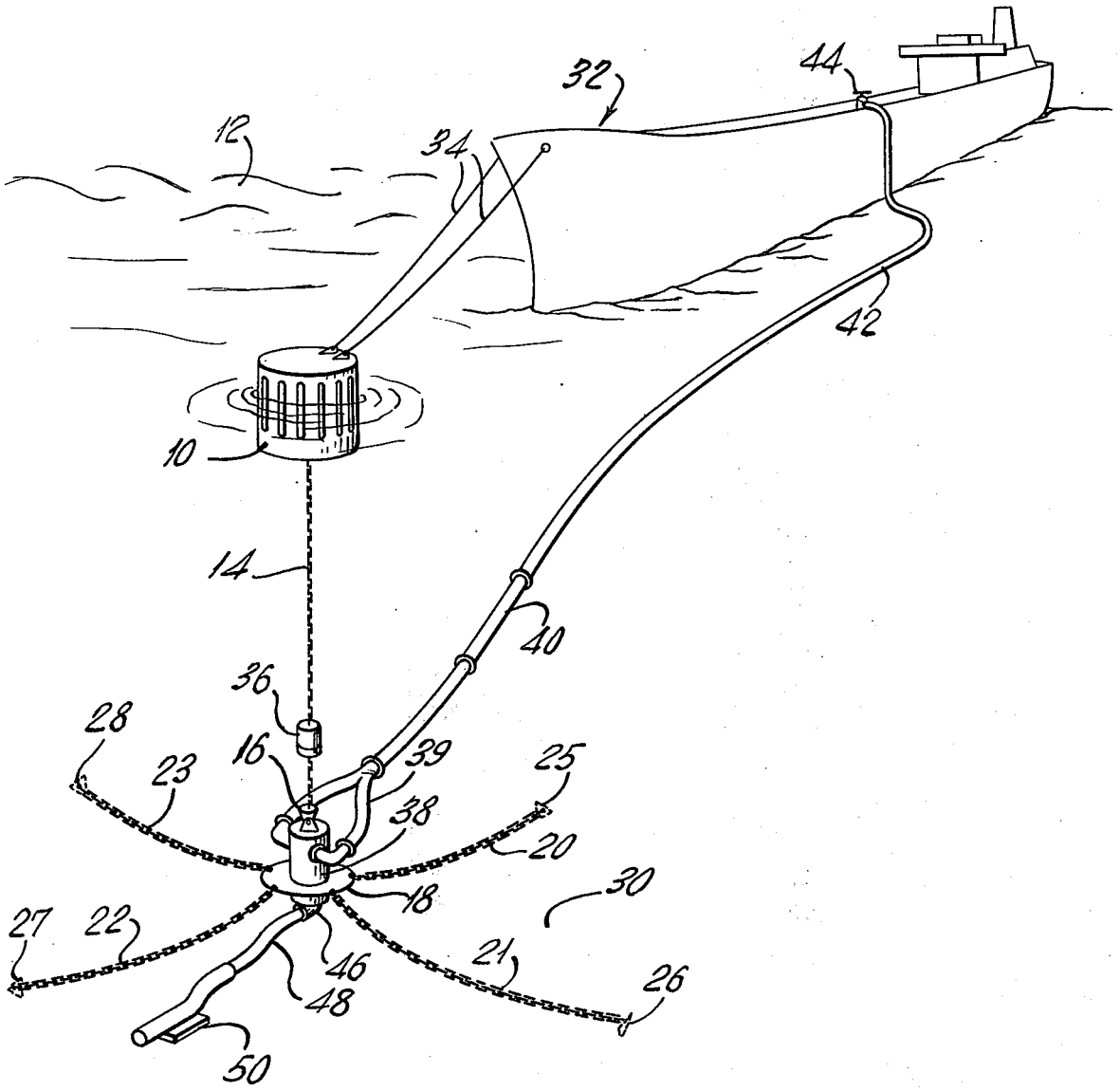
FIG. 1 illustrates a perspective view of the combined catenary and single anchor leg mooring for tankers according to the present invention.
Figure 2:
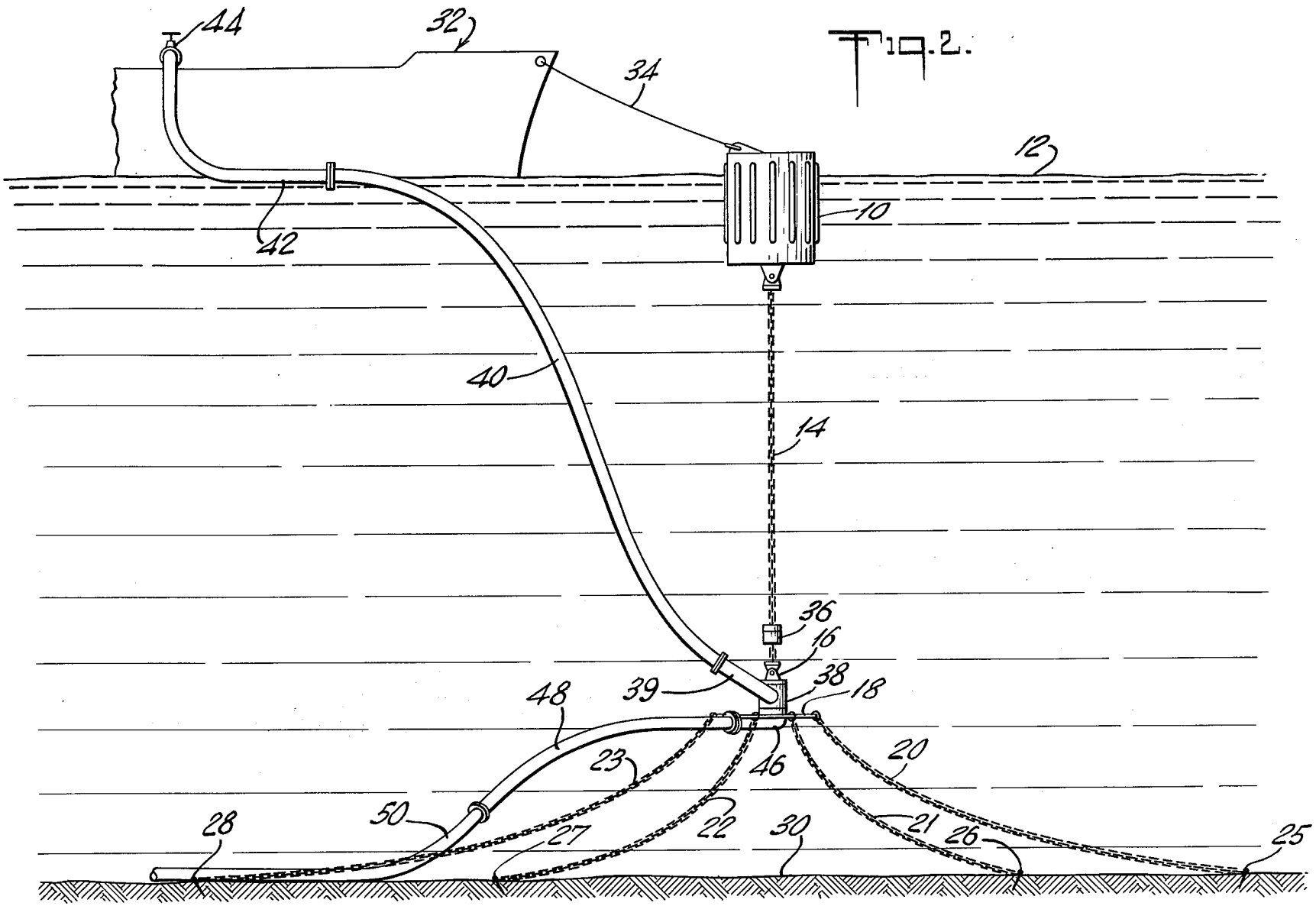
FIG. 2 illustrates an elevation view of the same combined catenary and single anchor leg mooring for tankers of FIG. 1.

Having reference to the drawings wherein like parts are designated by the same reference numeral in the several views, the present invention is illustrated wherein a mooring buoy 10 floating on the surface of the water 12 is moored in place by a single anchor leg 14 extending down to a load carrying shaft 16 mounted on an anchor hub 18 in the form of an annular plate member which in turn is moored by a plurality of anchor legs 20, 21, 22, and 23 extending radially outward and downward in the shape of catenaries to anchor points 25, 26, 27, and 28 embedded in the sea bottom 30. A vessel 32, for example an oil tanker, may moor to the mooring buoy 10 by means of mooring ropes 34. The single anchor leg 14 includes a mooring swivel 36 which enables the mooring buoy 10 to revolve relative to the leg, thus permitting the moored tanker 32 to rotate continuously about the mooring and to align its heading with the prevailing sea and weather environment. The single anchor leg 14 may be one chain, several chains suitably arranged in parallel, or a rigid or flexible shaft.

The cargo transfer swivel 38 rotatably mounted about shaft 16 is described in detail in U.S. Pat. No. 3,606,397, which to the extent required is incorporated herein by reference. While a particular cargo transfer swivel has been disclosed in the preferred embodiment, it is understood that various other swivel means may be employed, such as that disclosed in pending U.S. Patent application Ser. No. 320,053 now U.S. Pat. No. 3,838,718, assigned to the assignee of the present invention, so long as the system provides concentric rotatable cargo conduit means and mooring load carrying means. A bifurcated hose arm 39 extends from the rotatable cargo transfer swivel 38, and underwater cargo hose 40 extends from the hose arm upward to the ocean surface. Floating cargo hose 42 is conventionally joined to the underwater cargo hose 40 and may be raised to the deck of the moored vessel 32 and connected to its manifold 44. Piping 46 in operable association with and extending down from the anchor hub 18 is in fluid communication with the rotatable cargo transfer swivel 38. Underwater cargo hose 48 extends from the piping 46 to a manifold 50 secured at the end of the submarine pipeline (not shown). Cargo may be discharged from the moored vessel 32 through the floating hose 42 and underwater hose 40 to the hose arm 39 and through the cargo transfer swivel 38. From the cargo transfer swivel 38 the cargo flows through the piping 46 and the underwater hose 48 to the submarine pipeline manifold 50. In loading cargo to the vessel, cargo flows through the path just described in the opposite direction.

The mooring load exerted by the tanker on the mooring is transmitted through the mooring lines 34 to the buoy 10. As the buoy is pulled to the side, tension in the single anchor leg 14 increases and the anchor hub 18 is pulled upward and to the side. This increases tension in the catenary anchor legs 20, 21, 22, and 23 and lifts chain from the sea floor until equilibrium in the mooring system is restored. The weight of the anchor hub 18 is preferably greater than the weight of the water it displaces, thus exerting a substantial tension in the single anchor leg 14 and favorably influencing the properties of the mooring system.

It will be appreciated from the foregoing description that while there has been disclosed a specific construction and arrangement, this is intended only to be representative of a preferred embodiment and that various changes and modifications (e.g. an articulated loading arm in lieu of hose) may be made therein without departing from the clear teachings of the present disclosure. Accordingly, reference should be made to the following appended claims in determining the full scope of the invention.

What is claimed is:

1. A system for mooring and loading or unloading a vessel at an offshore site comprising:

a mooring buoy for receiving a mooring load and mooring said vessel directly thereto floating on the sea surface;

single anchor leg means carrying a mooring load when said vessel is moored to said mooring buoy attached to said buoy and extending downward therefrom;

anchor hub means suspended from said single anchor leg means at a predetermined distance below said sea surface and having a weight greater than the weight of the water displaced such that said hub means exerts tension on said single anchor leg means;

a plurality of anchor legs extending radially outward and downward from said hub means to anchor points on the sea floor;

a cargo transfer swivel assembly rotatably mounted on said hub and operably connected to cargo piping in said hub;

first cargo hose operably connected to said cargo piping and adapted for connection to a submarine pipeline manifold; and second cargo hose operably connected to said cargo transfer swivel assembly and extending to said sea surface where it may be picked up by a vessel moored to said mooring buoy.

2. The system of claim 1 including a mooring swivel connected between the ends of said single anchor leg means for permitting relative rotation therebetween.

3. The system of claim 2 further comprising a load-carrying shaft extending upward from said anchor hub means and about which said cargo transfer swivel assembly is rotatably mounted.

4. The system of claim 3 in which said single anchor leg means is connected to the top of said load-carrying shaft.

5. The system of claim 1 in which said anchor hub means includes an annular plate member.

6. The system of claim 1 in which said anchor legs are spaced about the periphery of said anchor hub means.

7. The system of claim 1 in which each of said anchor legs comprises a catenary configuration at least when said system is inoperable for mooring said tanker.

* * * * *